United States Patent [19]

Scott

[11] 4,007,651

[45] Feb. 15, 1977

[54] DEVICE FOR INCREASING THE TORQUE APPLIED TO A HAND TOOL

[76] Inventor: Douglas J. Scott, 62 Lawrence Ave., Smithtown, N.Y. 11787

[22] Filed: Oct. 1, 1975

[21] Appl. No.: 618,635

[52] U.S. Cl. ..... 81/180 R; 145/61 L

[51] Int. Cl.[2] ..... B25B 13/48

[58] Field of Search ..... 81/58.1, 121 B, 125, 81/175, 177 G, 180 R, 184; 145/50 B, 61 R, 61 L, 71

[56] References Cited

UNITED STATES PATENTS

| | | | |
|---|---|---|---|
| 425,655 | 4/1890 | Canedy | 81/175 UX |
| 608,866 | 8/1898 | Jones | 81/177 G X |
| 1,930,238 | 10/1933 | Heller | 81/177 G X |
| 2,621,688 | 12/1952 | Wales | 145/61 L X |
| 3,847,042 | 11/1974 | Wilson | 81/175 |

FOREIGN PATENTS OR APPLICATIONS

| | | | |
|---|---|---|---|
| 14,599 | 3/1956 | Germany | 145/61 L |

*Primary Examiner*—Al Lawrence Smith
*Assistant Examiner*—James G. Smith
*Attorney, Agent, or Firm*—Kevin Redmond

[57] ABSTRACT

A generally disc shaped tool shaft holder with an opening at its center adapted to accept a tool shaft, and a plurality of openings about its periphery, each of which is designed to accept a lever arm. The holder is divided into an inner and an outer section which may be detached from one another. The outer section may be used with a number of different inner sections, each of which is adapted for use with a particular tool.

8 Claims, 5 Drawing Figures

DEVICE FOR INCREASING THE TORQUE APPLIED TO A HAND TOOL

BACKGROUND

1. Field

This invention pertains to devices for increasing the torque applied to a tool and more particularly to devices which increase the torque applied to the shaft of a hand tool by means of a lever arm.

2. Prior Art

A number of prior art devices have included a lever arm to increase the torque applied to the shaft of a hand tool, but generally these devices require special tool bits which mate with only a particular shaft holder. This prior art type of holder generally cannot be used with conventional hand tools, such as a screw driver or allen wrench.

The lever arm of a number of prior art devices extends out from the shaft holder at a fixed angle with respect to the position of the tool head, causing the device to be inoperative in some applications because of mechanical interference.

The interference problem encountered with devices which have a fixed lever position has been alleviated to some extent by connecting the lever to the holder through a ratchet system, but the ratchet in a number of devices extends out from the shaft sufficiently to cause interference of its own.

SUMMARY

The principal object of the present invention is to overcome the disadvantages of the prior art and provide a simple, inexpensive device which can be used with a number of standard hand tools to apply high torque to the shaft of these tools without the need for special tool bits and ratcheted holding devices.

The main components of this invention are a lever arm and a non-ratcheting tool holder. The tool holder, which is generally disc shaped, has an opening at its center adapted to accept the shaft of a tool. The periphery of the holder contains a plurality of openings designed to accept one end of the lever arm. The lever arm may be inserted in any of the peripheral openings to avoid mechanical interference. By applying a force to the lever arm, a greater torque is applied to the tool shaft than can normally be applied by way of the tool handle.

The tool holder is divided into an inner and outer section to permit the outer section to be detached and used with a number of different inner sections, each of which may be designed for use with a particular tool.

DETAILED DESCRIPTION OF THE INVENTION

Figures 1, 2, 3, 4, 5:
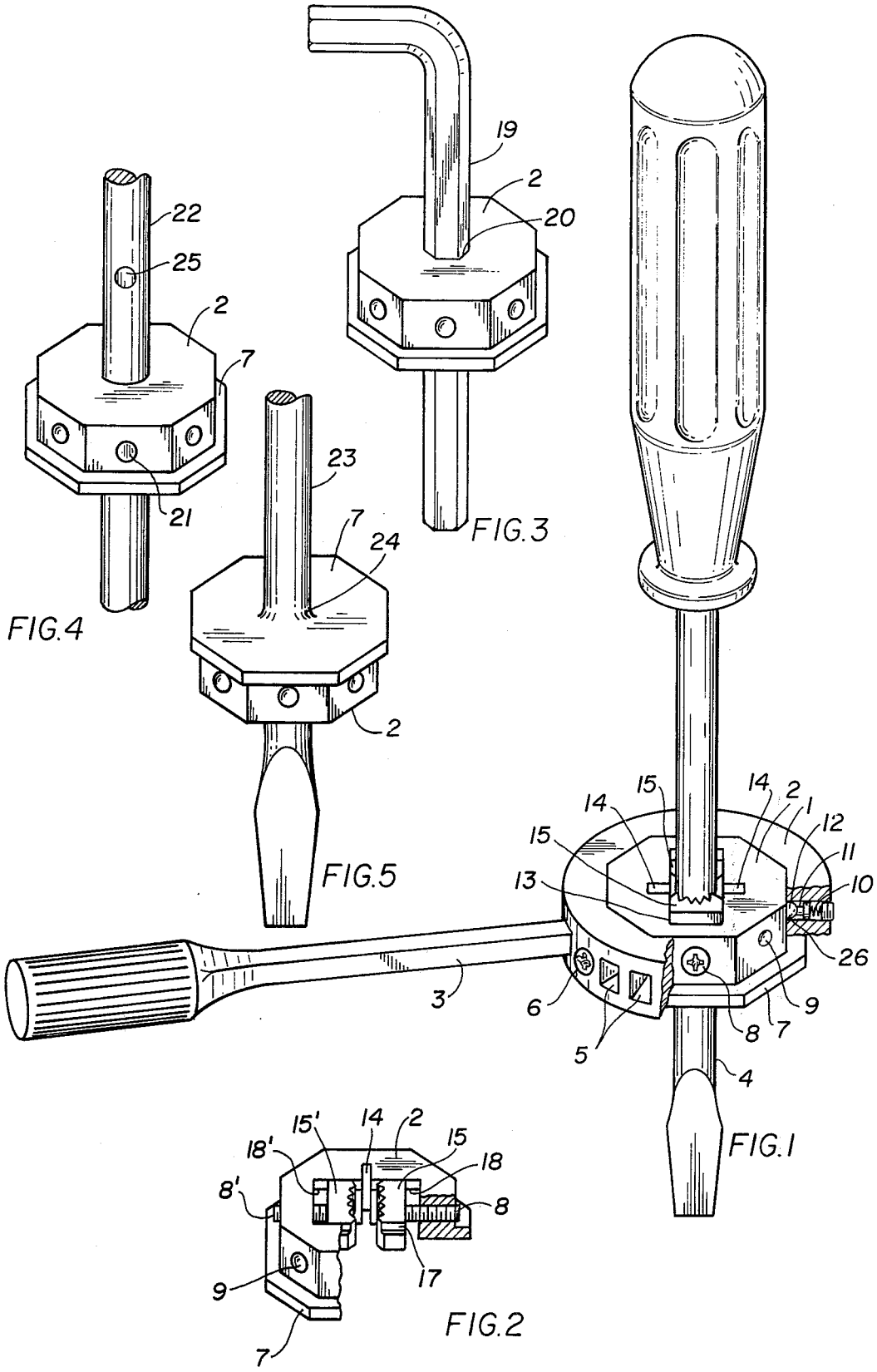
FIG. 1 is a perspective drawing of the invention with a section removed from the outer section of the tool holder to show the interface with the inner section.
FIG. 2 is a detailed perspective drawing of an inner holder with a section removed to show the jaws designed to grip the tool shaft.
FIG. 3 is a perspective view of an inner holder designed to grip a hexagonal toolshaft.
FIG. 4 is a perspective drawing of an inner holder secured to a shaft by means of a pin.
FIG. 5 is a perspective view of an inner holder permanently secured to a tool shaft.

Referring to FIG. 1, a tool holder comprised of an outer section 1 and an inner section 2 grips a tool shaft 4 by means of a jaw 15 located in an opening 13 in the center of the inner section. The opening 13 includes an elongated slot 14 to pass the wide portion of the screw driver blade. The outer section 1 of the tool holder contains a series of openings 5 about its periphery to accept one end of a lever arm 3.

A screw 8 is threaded through the inner portion of the holder 2 to bear against the jaw 15 which, in turn, bears against the shaft 4. The inner section 2 includes a flange 7 about its lower edge to support the outer section of the holder 1. A plurality of balls such as ball 12 located in an opening 26 within the outer section 1 each engage a respective spherical depression, such as depression 9, on the inner section of the holder to secure the two sections together.

The ball 12 is urged into a depression by a shaft 11 and spring 10 housed within the opening 26. The spring 10, which is captured within the outer portion of the holder 1, bears against a flanged end of the shaft 11. The balls are held within the outer portion of the holder by making the opening 26 smaller than the ball diameter at the inner surface of the outer section, but a portion of each ball extends out through its opening to engage the depressions. A force exerted against a ball that is sufficiently strong to overcome the force of the spring will force the ball back into the outer section of the holder and away from the holder surface.

A screw 6 which is threaded through the outer section of the holder and bears against the inner section may be used as an alternate or additional securing means.

Referring to FIG. 2, the inner section of the holder is shown rotated 90° about its vertical axis with respect to its position in FIG. 1. A section is removed to more clearly show the jaw 15 and an opposing jaw 15'. Each jaw may be individually tightened against the tool shaft by an associated screw 8 or 8'. A portion of all four corners of the jaws is removed to form a step such as step 17. The inner portion of the holder includes a mating surface 18 about the jaw steps retaining the jaws within the inner section with a tolerance that permits the jaws to slide in the direction to either grip or release the tool shaft.

FIG. 2 shows the screws 8 and 8' in positions used to hold the jaws open prior to accepting a tool. When the screws are advanced to tighten the jaws about a tool, the screws are driven into the inner section so that they do not protrude. With the screws so advanced, there is no interference between the inner and outer section. Where a tool with a large diameter shaft is to be secured, short screws may be employed to avoid interference.

The inner section of the holder has an octogonal outer surface which mates with the outer section to permit torque applied to the outer section to be transmitted to the inner section without significant slippage, however, the surface can be any irregular shape, where irregular is defined herein as a surface other than circular. This special definition of irregular includes any shape such as hexagonal or sawtooth which prevents relative movement between the two sections even though the individual sides of such figures may in themselves be uniform in length.

Referring to FIG. 3, the inner section of the holder 2 is secured to an irregular shaped tool shaft 19 such as that of an allen wrench by means of a mating irregular shaft opening 20, which replaces the jaws shown in FIGS. 1 and 2.

Referring to FIG. 4, an inner section of a holder 2 is secured to a tool shaft 22 by means of a pin 21 which passes through the inner section of the holder and the tool shaft.

Referring to FIG. 5, an inner portion of the holder 2 is secured to the tool shaft by permanent means such as by a weld 24. The flange 7 is shown in an alternate position on the upper side of the inner portion of the holder.

In the operation of the invention, the inner section is first connected to the tool shaft by a variety of methods including clamping as shown in FIG. 1 and 2, by a close fit to an irregular shape as shown in FIG. 3, by semipermanent means as shown in FIG. 4, or by permanent means as shown in FIG. 5. In FIG. 1, the tool shaft is passed through the opening 13 which may include a slit 14 or other contour to pass a tool head. The jaws 15 and 15′ may be tightened about any shaped shaft by appropriately adjusting the screws 8 and 8′.

A set screw, now shown, may be used to secure the inner section shown in FIG. 3 at any desired height on the shaft. The position of the inner section with respect to the shaft may also be varied in the version shown in FIG. 4 by providing a variety of holes for the pin 21, as for example, hole 25, which permits a higher mounting position on shaft 22.

Once the inner section has been connected to the shaft, the outer section of the holder is then connected to the inner section. By pressing the outer section on the inner section, the balls in the outer section are forced back away from the surface until they are aligned with the depressions in the inner section. The balls are then urged into these depressions by the springs to secure the two sections together. The outer portion may be removed for use with a different tool by applying pressure to the outer portion to separate it from the inner section. The balls are again forced back into the outer section releasing it from the inner section. If necessary for high torque operation, the outer portion may be more securely held to the inner section by incorporating a screw 6 which bears against the inner section.

It should be noted that a simple, but effective low cost version of this invention can be made by fabricating a one piece holder which can be secured to the tool shaft by any suitable means such as those described in connection with the inner section of the two sections holders.

The lever arm is inserted in any of the peripheral openings and pressure is applied to the lever to transmit a high torque to the tool shaft. The lever arm may be inserted in any of the peripheral openings to avoid mechanical interferences. The tool is steadied by holding the tool handle with one hand and the lever with the other, or two lever arms may be inserted, if desired, and the device is then steadied and rotated by means of both lever arms.

I claim:

1. Apparatus to increase the torque applied to the shaft of a hand tool comprising:

a. a lever arm, b. a generally disc shaped shaft holder with a first hole located at the center of the disc, the axis of said hole being colocated with the axis of revolution of the disc shaped shaft holder, and a plurality of holes located about the periphery of the holder with their axes oriented generally perpendicular to the axis of revolution of said disc shaped shaft holder, each hole of said set of holes adapted to accept one end of said lever arm, said holder being divided into an outer and inner section which are separable, said inner section including said first hole in the center of the holder and the outer section including said plurality of holes about the outer periphery of the holder, c. a first securing means to connect the tool shaft to the holder, said means being located about the periphery of said first hole, and d. a second securing means to connect said inner and outer sections, whereby a single outer section and a lever may be used in conjunction with a variety of different tools, each of which has a separate inner section adapted to accept a particular tool.

2. Apparatus as claimed in claim 1, wherein said first securing means includes an adjustable fastening device with a shaft, such as a screw, threaded through a second hole in said shaft holder in a direction generally perpendicular to the axis of revolution of the disc shaped shaft holder to apply pressure against the shaft and lock said holder to the shaft of said tool.

3. The Apparatus as claimed in claim 2, wherein said means for securing further includes jaws surrounding the shaft whereby said fastening device applies pressure to the jaws which in turn grip the tool shaft.

4. Apparatus as claimed in claim 1, wherein said first means for securing said holder to said tool shaft includes a pin which passes through said holder and tool shaft.

5. Apparatus as claimed in claim 1, wherein the sides of said first hole are in the form of an irregular shaped figure such as a hexagon to fit the contour of a tool such as an allen wrench.

6. Apparatus as claimed in claim 1, wherein said first securing means is made by permanent bonding, such as by welding or forging.

7. Apparatus as claimed in claim 1, wherein said first hole is shaped to pass a tool head such as by adding a slit on either side of a round opening to pass the head of a screw driver, whereby one holder may be installed on and removed from the shaft over the head of the tool to facilitate its use with a number of different tools.

8. Apparatus as claimed in claim 1, wherein the outer periphery of the inner section is in the form of an irregular figure, such as a hexagon and the inner surface of the outer section is shaped to mate with the irregular outer surface of the inner section, said second securing means including at least one ball in one of said sections and a detent in the other of said sections, the ball being biased to press into the detent when the sections are aligned, whereby the outer section may be quickly connected and disconnected from the inner section by applying pressure to the outer section along the axis of revolution of the holder to overcome the bias on the ball, and the end of one or more lever arms may be inserted in any of the said plurality of holes to apply torque to the tool shaft through the outer section, which transmits the torque through the mating irregular surface interface between the outer and inner sections, and through the first securing means to the tool shaft.

* * * * *